US009455531B2

(12) United States Patent
Qian et al.

(10) Patent No.: US 9,455,531 B2
(45) Date of Patent: Sep. 27, 2016

(54) ELECTRIC CONNECTOR FOR FLAT CONDUCTOR

(75) Inventors: Jigao Qian, Dongguan (CN); Jun Wan, Dongguan (CN); Shangsheng Cai, Dongguan (CN); Guangcai Hu, Dongguan (CN)

(73) Assignee: DONGGUAN YUQIU ELECTRONICS CO., LTD (CN)

( * ) Notice: Subject to any disclaimer, the term of this patent is extended or adjusted under 35 U.S.C. 154(b) by 0 days.

(21) Appl. No.: 14/396,738

(22) PCT Filed: Jun. 25, 2012

(86) PCT No.: PCT/CN2012/077437

§ 371 (c)(1),
(2), (4) Date: May 21, 2015

(87) PCT Pub. No.: WO2013/159445

PCT Pub. Date: Oct. 31, 2013

(65) Prior Publication Data

US 2015/0357764 A1 Dec. 10, 2015

(30) Foreign Application Priority Data

Apr. 24, 2012 (CN) ..... 2012 1 0121712

(51) Int. Cl.

| | |
|---|---|
| ***H01R 13/6581*** | (2011.01) |
| ***H01R 13/629*** | (2006.01) |
| ***H01R 12/77*** | (2011.01) |
| *H01R 13/58* | (2006.01) |

(52) U.S. Cl.

CPC ..... *H01R 13/6581* (2013.01); *H01R 12/772* (2013.01); *H01R 13/629* (2013.01); *H01R 13/5829* (2013.01)

(58) Field of Classification Search

USPC ..... 439/492, 260, 345, 328, 495, 374

See application file for complete search history.

(56) References Cited

U.S. PATENT DOCUMENTS

| | | | | |
|---|---|---|---|---|
| 6,089,905 | A * | 7/2000 | Shimmyo | H01R 12/79 439/260 |
| 7,175,472 | B2 * | 2/2007 | Wu | H01R 12/87 439/492 |
| 7,494,375 | B2 * | 2/2009 | Yoshikai | H01R 12/79 439/595 |
| 8,337,230 | B1 * | 12/2012 | Kurachi | 439/328 |
| 8,651,885 | B2 * | 2/2014 | Ashibu | H01R 12/774 439/328 |
| 8,968,020 | B2 * | 3/2015 | Nishiyama | H01R 13/627 439/345 |
| 2004/0203274 | A1 * | 10/2004 | Peng | H01R 12/57 439/329 |

(Continued)

*Primary Examiner* — Alexander Gilman

(57) ABSTRACT

The present invention discloses an electrical connector for flat conductor which includes an insulating body and a shielding housing. Vertical insert slots corresponding to two notches of the flat conductor are provided on the insulating body. An elastic buckling piece is formed in the vertical insert slot of the insulating body. The elastic buckling piece comprises an elastic arm extending obliquely upward and a buckling part formed through extending downward from a tail end of the elastic arm. One end of the elastic arm is connected integrally to the insulating body. A fixture block is disposed on an inner wall surface of the vertical insert slot in a protruding manner. The fixture block is located at a free end side of the elastic arm, and the fixture block is located below the buckling part. After the flat conductor is inserted, the elastic buckling piece is pressed down until the buckling part is buckled below the fixture block of the insulating body. The structure is simple, and is easy to produce and manufacture. Meanwhile, the assembly is convenient and the assembled flat conductor is firm and does not come off easily. Therefore the production efficiency and the production quality are improved effectively.

9 Claims, 7 Drawing Sheets

(56) References Cited

U.S. PATENT DOCUMENTS

2005/0215109 A1* 9/2005 Satou ..... H01R 12/89
439/492
2008/0146075 A1* 6/2008 Mundt ..... H01R 13/5829
439/492
2010/0130045 A1* 5/2010 Higuchi ..... H01R 12/62
439/260
2010/0261375 A1* 10/2010 Wang ..... H01R 12/88
439/492
2011/0275238 A1* 11/2011 Iijima ..... H01R 12/88
439/492
2012/0100736 A1* 4/2012 Ashibu ..... H01R 12/88
439/260
2012/0258618 A1* 10/2012 Sasaki ..... H01R 12/78
439/260
2013/0196529 A1* 8/2013 Jung ..... H01R 12/774
439/345
2013/0309887 A1* 11/2013 Honda ..... H01R 13/193
439/260

* cited by examiner

A—A

A — A

B—B

C—C

ELECTRIC CONNECTOR FOR FLAT CONDUCTOR

FIELD OF THE INVENTION

The present invention relates to an electric connector, particularly to an electric connector for flat conductor of LCD signal transmission.

BACKGROUND OF THE INVENTION

With the rapid development of network and communication technology, the consumers' demands for the transmission speed are increasing. The electric connectors used in computers and electronic products must be able to transmit high-frequency and high-speed signals. Therefore, the connector of low voltage differential signal (LVDS) has been developed in recent years, which utilizes high-speed vibration of extremely low voltage amplitude to transmit the data. It has the advantages of low power consumption and low bit error rate.

The main structure of existing LVDS connector comprises an insulating body and a shielding housing. The insulating body has a front and a rear opening space. The flat conductor is inserted into the rear opening, and the connecting part of the flat conductor is at the front opening. In order to avoid the loosening and failing of the flat conductor (such as FPC or FFC), a notch is provided on the flat conductor, and a limiting device is affixed to the notch to stabilize the flat conductor. However, the structure of the limiting device of conventional LVDS connector is complex and the assembly method is complicated, which affects the production efficiency. Moreover, some LVDS connectors are easy to come off after assembly.

Therefore, a new technical scheme needs to be developed to address said problem.

SUMMARY OF INVENTION

In view of this, the primary objection of the present invention is to provide an electric connector for flat conductor for improving the existing deficiency, the structure is simple and easy to produce, and can firmly secure the flat conductor, thereby effectively improving the production efficiency and product quality.

To realize the above-mentioned objection, the present invention adopts the following technical schemes:

A electrical connector for flat conductor, comprising an insulating body having an guiding slot of an opening arranged on one side thereof capable of being formed into an connecting part in front side for inserting the flat conductor therein, on the opposite side, an inserting part being provided for insertion of the corresponding connector, said inserting part having an insert slot connected to said guiding slot, the connecting part on the flat conductor being inserted from the guiding slot and positioned on said inserting part to be in contact with the corresponding connector, which is characterized in that the insert slot passing through the guiding slot are provided on the insulating body along the thickness direction of flat conductor at the locations corresponding to the stopping parts of the flat conductor respectively;

an elastic buckling piece integrally formed inside one end of the insert slot and a fixture block formed in a protruding manner in the other end, said elastic buckling piece included an elastic arm and a buckling part connected to the insulting body, after the flat conductor is inserted, under the elastic action of elastic arm, a free end of the elastic buckling piece, the elastic buckling piece can be pressed down to buckle on the fixture block, the buckling part arranged above the fixture block extended into the guiding slot and buckled at a stop part of the flat conductor to prevent the flat conductor from came off.

As a preferred embodiment, a connecting arm is protruded from the insulating body inside the insert slot, said elastic arm connected with the connecting arm.

As a preferred embodiment, an inclined surface is disposed on the buckling part to resist the flat conductor.

As a preferred embodiment, said buckling part is equipped with a receding groove to provide flexibility for the movement of guiding part.

As a preferred embodiment, the left and right sides of said inserting part are provided with a limiting part respectively for stopping the front end of the flat conductor.

As a preferred embodiment, the front end of said inserting part is provided with an anti-warping part for stopping the front end of the flat conductor.

As a preferred embodiment, said connector comprises a shielding housing and left and right hooks.

As a preferred embodiment, said shielding housing and left and right hooks are formed integrally; the hook comprises of a stopping part, an elastic compression part and a hook part; the stopping part is connected integrally onto the shielding housing.

As a preferred embodiment, said shielding housing is disposed inside the insulating body, said shielding housing provided with a fastening structure for fixing the insulating body.

As a preferred embodiment, a grounding elastic piece is disposed on a housing substrate of the shielding housing, said grounding elastic piece extended into the guiding groove and contacted with the flat conductor.

Compared with the prior art, the present invention has obvious advantages and beneficial effects, in particular, as revealed in the above technical scheme:

Firstly, the flat conductor is buckled by the elastic buckling piece formed integrally on the insulating body, the elastic buckling piece is raised upward in the nature state, after the flat conductor is inserted, the elastic buckling piece is pressed down until the buckling part buckled the fixture block of the insulating body; the structure is simple and manufacture is easy, simultaneously, assembly is convenient and the flat conductor is not easy to come off after assembly, so as to improve the efficiency for production and quality.

Secondly, an pushing slope is disposed on the buckling part to resist the flat conductor whereby the buckling part buckled under the rear of the fixture block of the insulating body, the flat conductor adjoined closely to the bottom of the guiding groove under the pressure of the inclined surface, which prevented effectively the flat conductor from up and down vibration, and further improved the firmness for assembly; besides, a receding groove is concavely arranged at the bottom surface upward of the buckling part, which can help the buckling part being deformed when pressed into the notch of the flat conductor, so that the buckling part pressed easily into the notch of the flat conductor, after that, the inclined surface is more closely resisted on the flat conductor under the action reciprocal spring force.

Thirdly, a limiting part arranged in the opening of the front end of the guiding slot and protruding upward, which improved the function of limiting position for the flat conductor and increased the firmness and the quality for assembly.

Further benefits and advantages of the present invention will become apparent after a careful reading of the detailed description with appropriate reference to the accompanying drawings.

DETAILED DESCRIPTION OF THE PREFERRED EMBODIMENTS

Referring to FIGS. 1 to 7, a preferred embodiment of the present invention, comprising an insulating body 10, a shielding housing 20 and a flat conductor 30, and said flat conductor 30 is provided with two notches 31.

Figure 1:
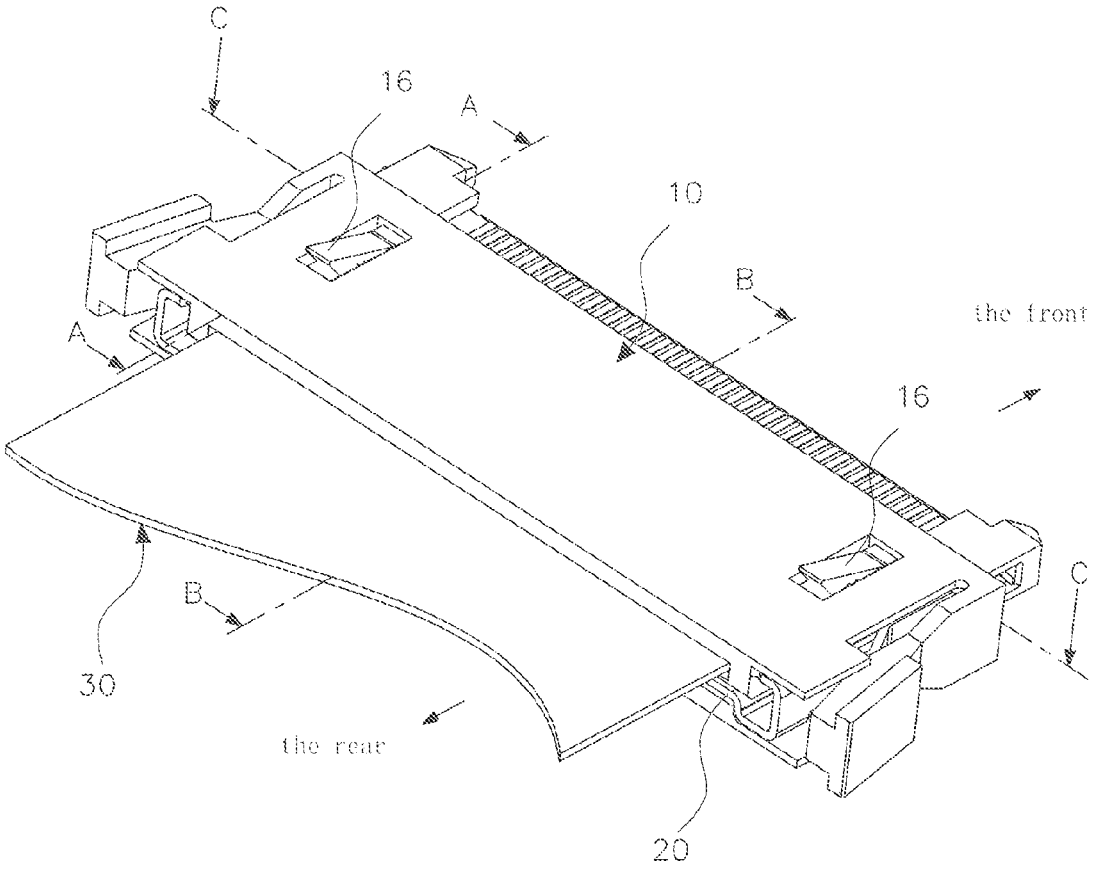
FIG. 1 is a perspective view of a preferred embodiment of the present invention.
Figure 2:
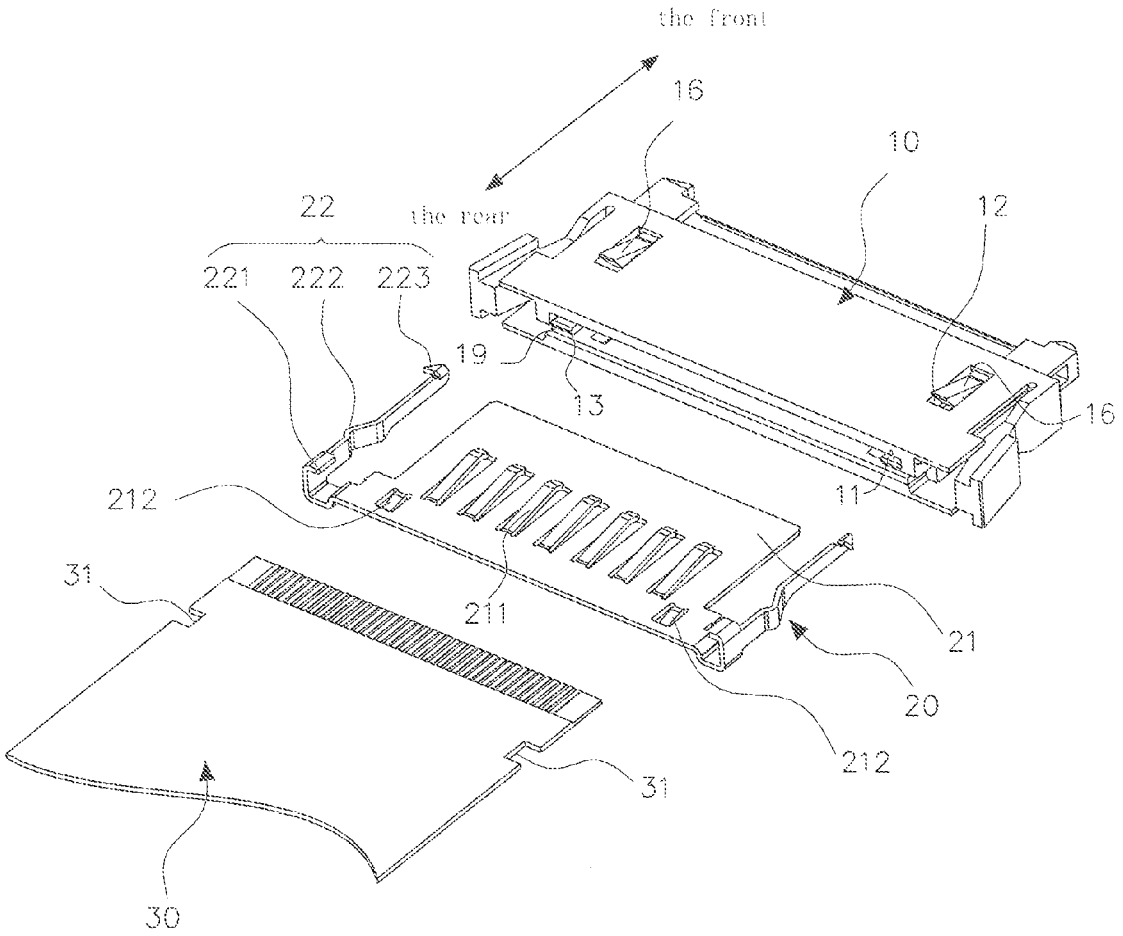
FIG. 2 is an exploded view of a preferred embodiment of the present invention.
Figure 7:
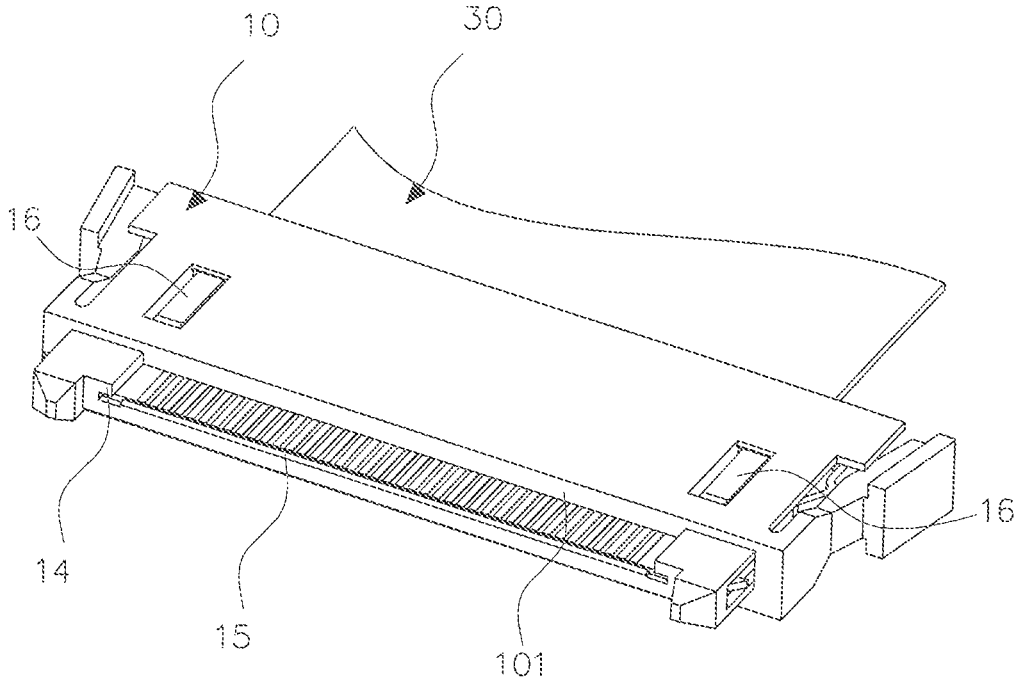
FIG. 7 is a perspective view of another assembly in a preferred embodiment of the present invention.

As shown in FIG. 2, said insulating body 10 is formed integrally. A guiding slot 11 is provided on one side of the insulating body 10 to guide the front connecting part of the flat conductor 30 to the notch. On the opposite side, an inserting part is provided for the insertion with the corresponding connector. A contacting face 101 connected to said guiding slot 11 is provided on the inserting part. The connecting part on the flat conductor 30 is led in from the guiding slot 11 and positioned on said inserting part to contact with the corresponding connector. The guiding slope 13 at the rear opening of the guiding slot 11 can allow the flat conductor 30 to be inserted easily. As shown in FIG. 7, the left and right sides of the contacting face 101 are provided with an anti-warping part 14 for pressing down the front part of the flat conductor 30 to prevent the front connecting part from tilting upwards. A limiting part 15 is provided at the protruding part of the front opening of the contacting face 101, and is used to stop the front part of the flat conductor 30 backwards, thus having a limiting effect on the front part of the flat conductor 30.

Corresponding to the locations of notches 31, two insert slots 12 are provided on the insulating body 10. After the flat conductor 30 is inserted completely into said guiding slot 11, the insert slots 12 are connected between said guiding slot 11 and the external side of the insulating body 10 along the thickness direction of the flat conductor 30.

Figure 3:
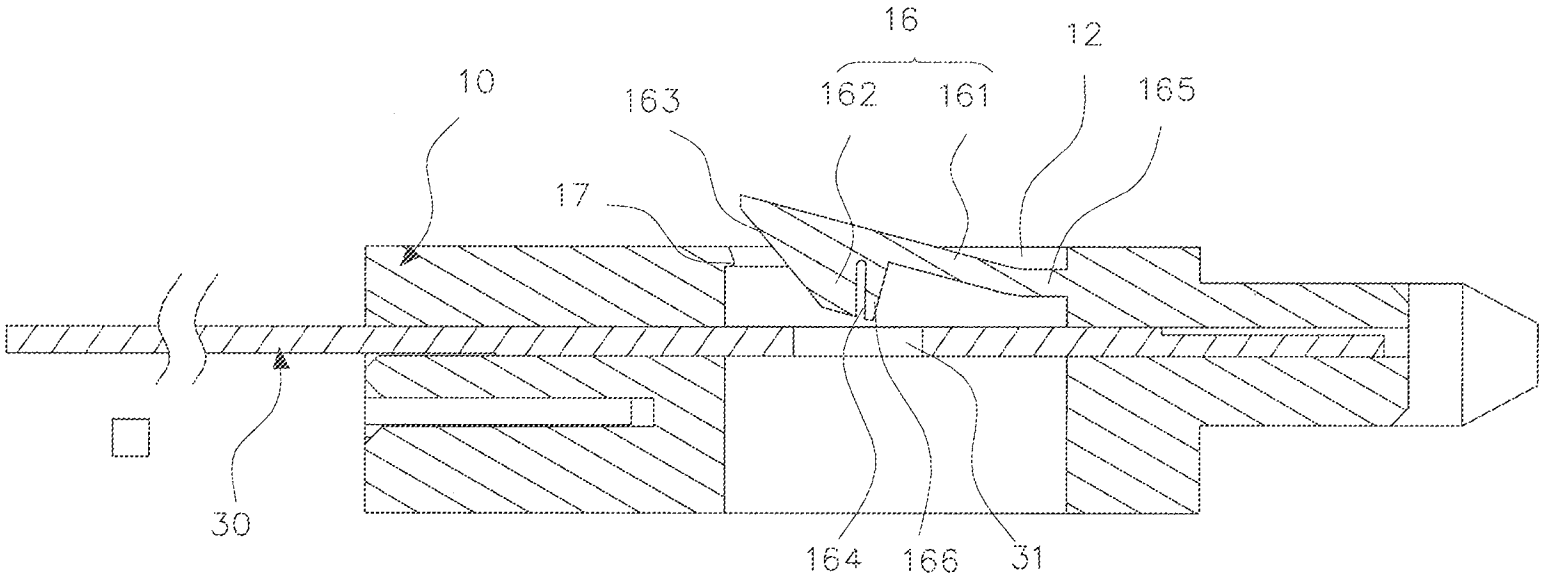
FIG. 3 is an enlarged view of the section at location A-A in FIG. 1 (in nature state)

In the second holding space 12, an elastic buckling piece 16 is provided integrally on the insulating body 10. Said elastic buckling piece 16 comprises an elastic arm 161 extending laterally and a buckling part 162 extending vertically. One end of said elastic arm 161 is connected integrally onto the insulating body 10. Said buckling part 162 is formed by extending from the other end of elastic arm 161. And, a connecting arm 165 arranged inside the insert slot 12 and protruded from the insulating body 10, which is connected with the elastic arm 161 (as shown in FIG. 3), and a fixture block 17 is disposed on an inner wall surface of the vertical insert slot 12 in a protruding manner. The fixture block 17 is located at a free end side of the elastic arm 161, and the fixture block 17 is located below the buckling part 162; in the nature state, the elastic arm 161 of the elastic buckling piece 16 raised upward, the buckling part 162 located inside the insert slot 12, the flat conductor 30 can insert freely into the guiding slot 11 (as shown in FIG. 3); after the flat conductor 30 fully inserted into the guiding slot 11, the elastic buckling piece 16 is pressed down until the buckling part 162 of the is buckled below the fixture block 17 of the insulating body 10, and then the buckling part 162 extended into the guiding slot 11, which is the buckling part 162 buckled into the notch 31 of the flat conductor 30, so the flat conductor 30 is fixed firmly to prevent it from came off the guiding slot 11 (as shown in FIG. 4), moreover, the external surface of the elastic buckling piece 16 will not over the external surface of the insulating body 10, it has the advantage of neatness of appearance for the insulating body 10.

Figure 4:
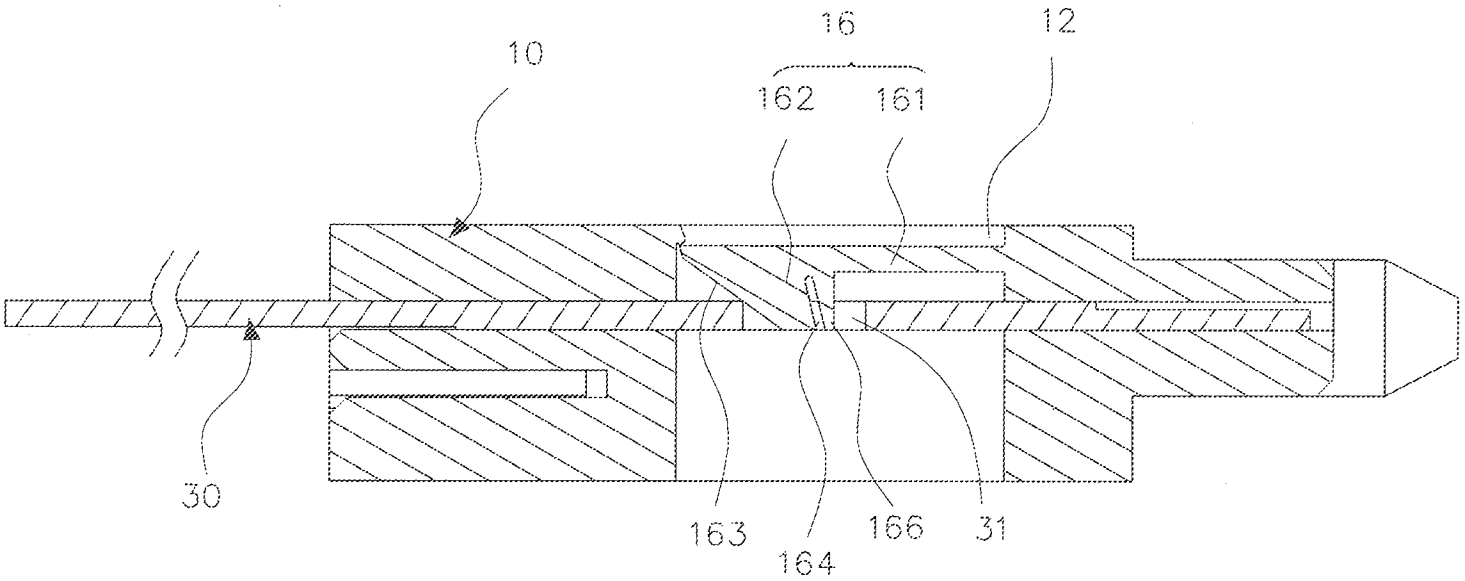
FIG. 4 is an enlarged view of the section at location A-A in FIG. 1 (in buckled state)
Figure 5:
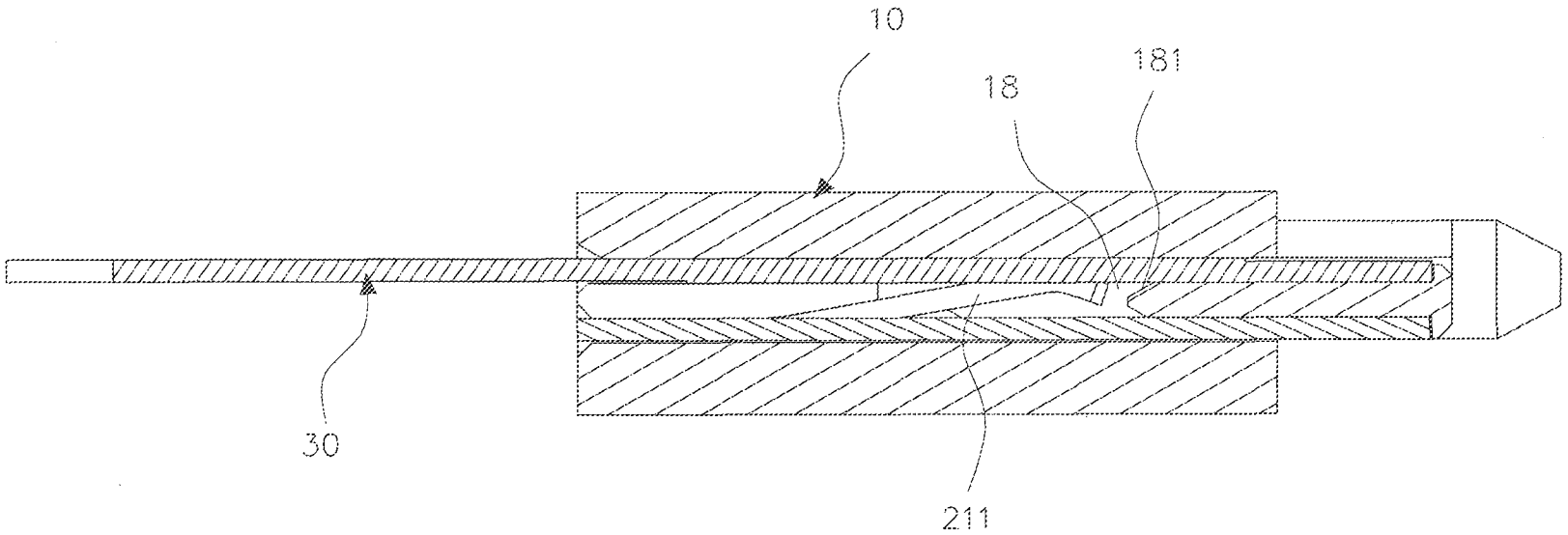
FIG. 5 is an enlarged view of the section at location B-B in FIG. 1.
Figure 6:
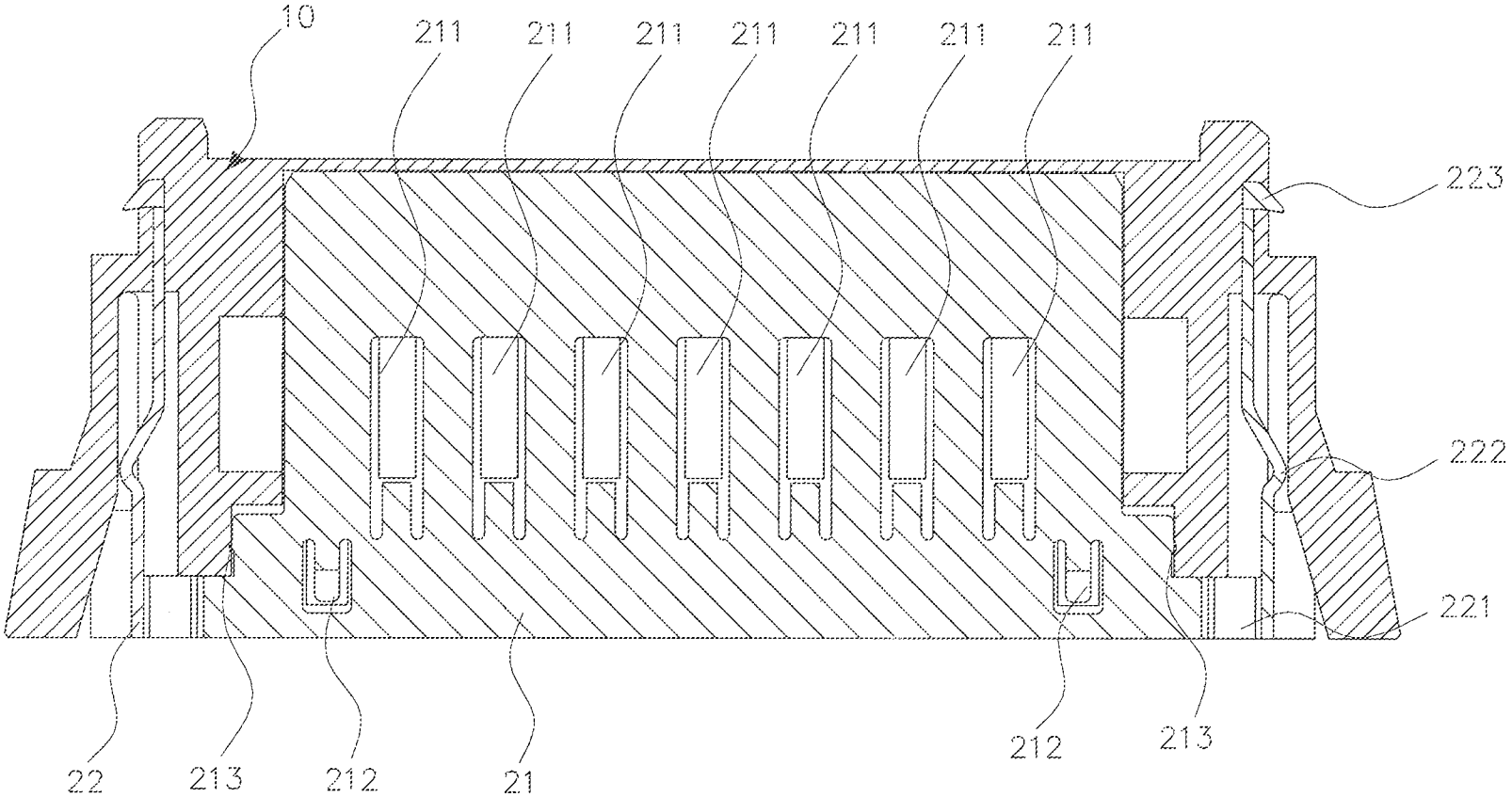
FIG. 6 is an enlarged view of the section at location C-C in FIG. 1.

Referring to FIG. 3 and FIG. 4, the pushing slope 163 is provided on the buckling part 162. Under the pressure of the pushing slope 163, the surface of flat conductor 30 is in close contact with the bottom of guiding slot 11, thus effectively preventing from the upward and downward vibration of flat conductor 30. A receding groove 164 is provided for the deformation in the case that the buckling part 162 is squeezed into the notch 31 of flat conductor, and recessed upwards on the bottom surface of said buckling part 162. In the embodiment, a guiding part 166 is provided on the buckling part 162. Said guiding part 166 is deformed when it is squeezed into the notch 31, so that said buckling part 162 can be easily buckled into the notch 31 of the flat conductor 30. After the buckling part 162 is buckled in the notch 31, said pushing slope 163 can be tightly pushed onto the flat conductor 30 acted by the elastic resetting force of buckling part 62.

The shielding housing 20 is located inside the insulating body 10. The holding slot 19 is provided under said guiding slot 11 for the insertion of shielding housing 20. The shielding housing 20 comprises a housing substrate 21 and two hooks 22 connected to the left and right side of housing substrate 21 respectively. The hook 22 comprises a stopping part 221, an elastic compression part 222, and a hook part 223, which are connected integrally. The two stopping parts 221 are connected integrally on the left and right sides of housing substrate 21 respectively (as show in FIG. 2). The side of housing substrate 21 extends integrally outwards to form a stopping point 213. After the shielding housing 20 is assembled inside the insulating body 10, the stopping point 213 is pushed tightly onto the insulating body 10 (as show in FIG. 6), moreover, the shielding housing 20 is further provided with an elastic limiting point 212 to facilitate insertion of the flat conductor 30 and a grounding elastic piece 211 for contacting with the flat conductor 30; A through slot 18 is formed between said housing substrate 21 and said guiding slot 11 for the movement of the grounding elastic piece 211. A guiding slant 181 is formed at the front end of through slot 18 (as show in FIG. 5) for inserting the flat conductor 30.

During assembly, the shielding housing 20 is inserted into the holding slot 19 and then pressed the elastic buckling piece 16 to buckle into the notches 31 of the flat conductor 30, therefore, the assembly and connection between the connector and the flat conductor 30 is completed.

The present invention provides an integral structure of the elastic buckling piece on the insulating body to be connected with the flat conductor, the elastic buckle piece is raised upward in natural state, after the flat conductor, the elastic buckle piece pressed down until the buckling part buckled the fixture block of the flat conductor; the structure is simple and easy to produce, and can firmly secure the flat conductor, thereby effectively improving the production efficiency and product quality. Secondly, an pushing slope is disposed on the buckling part to resist the flat conductor whereby the buckling part buckled under the rear of the fixture block of the insulating body, the flat conductor adjoined closely to the bottom of the guiding groove under the pressure of the inclined surface, which prevented effectively the flat conductor from up and down vibration, and further improved the firmness for assembly;

It will be evident to those skilled in the art that the invention is not limited to the details of the foregoing illustrated embodiments and that the present invention may be embodied in other specific forms without departing from the spirit or essential attributes thereof. The present embodiments are therefore to be considered in all respects as illustrative and not restrictive, the scope of the invention being indicated by the appended claims rather than by the foregoing description, and all changes which come within the meaning and range of equivalency of the claims are therefore intended to be embraced therein.

We claim:

1. A electrical connector for flat conductor, comprising an insulating body having an guiding slot of an opening arranged on one side thereof capable of being formed into an connecting part in front side for inserting the flat conductor therein, on the opposite side, an inserting part being provided for insertion of the corresponding connector, said inserting part having an insert slot connected to said guiding slot, the connecting part on the flat conductor being inserted from the guiding slot and positioned on said inserting part to be in contact with the corresponding connector, which is characterized in that:

the insert slot passing through the guiding slot are provided on the insulating body along the thickness direction of flat conductor at the locations corresponding to the stopping parts of the flat conductor respectively;

an elastic buckling piece integrally formed inside one end of the insert slot and a fixture block formed in a protruding manner in the other end, said elastic buckling piece included an elastic arm and a buckling part connected to the insulting body, after the flat conductor is inserted, under the elastic action of elastic arm, a free end of the elastic buckling piece, the elastic buckling piece can be pressed down to buckle on the fixture block, the buckling part arranged above the fixture block extended into the guiding slot and buckled at a stop part of the flat conductor to prevent the flat conductor from came off;

wherein the connector comprises a shielding housing and left and right hooks.

2. The structure as defined in claim 1, which is characterized in that a connecting arm is protruded from the insulating body inside the insert slot, said elastic arm connected with the connecting arm.

3. The structure as defined in claim 1, which is characterized in that an inclined surface is disposed on the buckling part to resist the flat conductor.

4. The structure as defined in claim 1, which is characterized in that said buckling part is equipped with a receding groove to provide flexibility for the movement of guiding part.

5. The structure as defined in claim 1, which is characterized in that the left and right sides of said inserting part are provided with a limiting part respectively for stopping the front end of the flat conductor.

6. The structure as defined in claim 1, which is characterized in that the front end of said inserting part is provided with an anti-warping part for stopping the front end of the flat conductor.

7. The structure as defined in claim 1, which is characterized in that said shielding housing and left and right hooks are formed integrally; the hook comprises of a stopping part, an elastic compression part and a hook part; the stopping part is connected integrally onto the shielding housing.

8. The structure as defined in claim 1, which is characterized in that said shielding housing is disposed inside the insulating body, said shielding housing provided with a fastening structure for fixing the insulating body.

9. The structure as defined in claim 1, which is characterized in that a grounding elastic piece is disposed on a housing substrate of the shielding housing, said grounding elastic piece extended into the guiding groove and contacted with the flat conductor.

* * * * *